US008142628B2

(12) United States Patent
Narita et al.

(10) Patent No.: US 8,142,628 B2
(45) Date of Patent: Mar. 27, 2012

(54) SEALING JIG AND SEALING METHOD FOR CYLINDER BLOCK PLATING APPARATUS

(75) Inventors: Osamu Narita, Hamamatsu (JP); Manabu Suzuki, Hamamatsu (JP); Tetsuya Kuroda, Hamamatsu (JP); Hiroyuki Oishi, Hamamatsu (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 182 days.

(21) Appl. No.: 12/796,190

(22) Filed: Jun. 8, 2010

(65) Prior Publication Data

US 2010/0314836 A1 Dec. 16, 2010

(30) Foreign Application Priority Data

Jun. 10, 2009 (JP) ..... 2009/139578

(51) Int. Cl.
*C25D 17/06* (2006.01)
*C25B 9/02* (2006.01)

(52) U.S. Cl. ..... 204/297.07; 204/297.01; 277/590; 277/591; 277/602; 277/607; 277/614; 277/616; 277/626; 277/628; 277/644; 277/645

(58) Field of Classification Search ..... 204/297.01, 204/297.07; 277/590, 591, 602, 607, 614, 277/616, 626, 628, 644, 645
See application file for complete search history.

(56) References Cited

U.S. PATENT DOCUMENTS

| | | | | |
|---|---|---|---|---|
| 5,804,043 | A * | 9/1998 | Ikegaya | 204/224 R |
| 5,810,990 | A * | 9/1998 | Ikegaya | 205/122 |
| 2009/0223813 | A1* | 9/2009 | Muramatsu et al. | 204/224 R |
| 2009/0223828 | A1* | 9/2009 | Muramatsu et al. | 205/131 |
| 2009/0277786 | A1* | 11/2009 | Asou et al. | 204/267 |
| 2011/0162961 | A1* | 7/2011 | Muramatsu et al. | 204/275.1 |

FOREIGN PATENT DOCUMENTS

JP 08-053798 2/1996

* cited by examiner

*Primary Examiner* — Bruce Bell
(74) *Attorney, Agent, or Firm* — Barnes & Thornburg LLP

(57) ABSTRACT

A cylinder block plating apparatus preplates or plates a cylinder bore of each cylinder in a cylinder block of a multi-cylinder engine using a process liquid introduced into the cylinder bore in a condition of sealing an end of the cylinder bore when a communication hole is formed at the end of the cylinder bore, the cylinder block plating apparatus includes a sealing jig including a sealing unit including a cylinder bore seal for sealing the end of an inner peripheral surface of the cylinder bore and a communication hole seal for sealing a portion, near a communication hole, opposite to the cylinder inner peripheral surface, and a clamping unit disposed in the sealing unit to be pushed open and adapted to cause the communication hole seal to seal the portion located on the opposite side of the cylinder bore near the communication hole. The sealing is performed by sealing the end of an inner peripheral surface of the cylinder bore, and sealing a portion located on an opposite side of the cylinder bore in a periphery of the communication hole.

5 Claims, 8 Drawing Sheets

SEALING JIG AND SEALING METHOD FOR CYLINDER BLOCK PLATING APPARATUS

BACKGROUND OF THE INVENTION

1. Field of the Invention

The present invention relates to a sealing jig and a sealing method for a cylinder block plating apparatus, which is usable for sealing an end of an inner peripheral surface, i.e., cylinder bore, of each cylinder in a cylinder block of an engine of a vehicle, for example, when the cylinder bores are preplated or plated by circulating a process liquid.

2. Related Art

Cylinder block plating apparatus are conventionally proposed which plate cylinder bores by circulating a process liquid with cylinder bores of cylinders in a cylinder block sealed at both ends (on the side of a crankcase and on the side of a cylinder head).

Such conventional apparatus includes an apparatus such as disclosed in Patent Document 1 (Japanese Patent Laid-Open No. 8-53798), and in this conventional apparatus, a sealing member capable of being expanded and deformed into the cylinders from the crankcase side and the crankcase-side end of each cylinder bore is sealed with the sealing member.

However, in cylinder blocks of some multi-cylinder engines, in order to reduce pumping losses and improve engine power, communication holes are formed at an end of the cylinder bore of each cylinder. When plating process is performed to the inner peripheral surface of the cylinder bores in the cylinder block having such communication holes by using a process liquid as described above, it is necessary to take measures to prevent the process liquid from leaking out of the cylinders through the communication holes as well as to prevent leakage from one end of each of the cylinder bores. Further, it is to be noted that the term "cylinder bore" may be equivalently described hereunder to "inner peripheral surface of the cylinder".

SUMMARY OF THE INVENTION

The present invention was conceived in consideration of the circumstances encountered in the prior art mentioned above, and an object of the present invention is to provide a sealing jig and a sealing method for a cylinder block plating apparatus capable of prevent a preplating solution or plating solution from contacting components or members other than cylinder bores and communication holes of the cylinders even when such communication holes are formed at the end portions of the cylinder bores in the cylinder block of a multi-cylinder engine.

The above and other objects can be achieved according to the present invention by providing, in one aspect, a sealing jig for a cylinder block plating apparatus which preplates or plates a cylinder bore of each cylinder in a cylinder block of a multi-cylinder engine with a process liquid introduced into the cylinder bore in a condition of sealing an end of the cylinder bore when a communication hole is formed at the end of the cylinder bore, the sealing jig including: a sealing unit including a cylinder bore seal for sealing the end of an inner peripheral surface of the cylinder bore and a communication hole seal for sealing a portion, in a periphery of the communication hole, opposite to the cylinder inner peripheral surface; and a clamping unit disposed in the sealing unit to be pushed open and adapted to cause the communication hole seal to seal the portion located on the opposite side of the cylinder bore in the periphery of the communication hole.

In the above aspect, it may be desired that the end of the cylinder bore is located on a crankcase mounting surface side in a cylinder block in which a crank journal provided with a crank bearing extends inward of the cylinder.

The sealing unit may include positioning brackets adapted to position the sealing unit at a level in a height direction by being locked to the crankcase mounting surface and positioning blocks adapted to position the sealing unit along a circumferential direction of the seal unit by being engaged with the crank bearings. It may be desired that the portion located on the opposite side of the cylinder bore on the periphery of the communication hole is a honing relief surface formed on each of the crank journals for use during honing working of the cylinder bore.

In another aspect of the present invention, there is also provided a method of sealing the cylinder block plating apparatus, mentioned above, the sealing method including the steps of: sealing the end of an inner peripheral surface of the cylinder bore; and sealing a portion located on an opposite side of the cylinder bore in a periphery of the communication hole.

According to the present invention of the characters mentioned above, even if a communication hole is formed at an end of a cylinder bore of each cylinder in a cylinder block of a multi-cylinder engine, the sealing jig and the sealing method for a cylinder block plating apparatus of the present invention can seal a portion located on an opposite side of the cylinder bore in a peripheral portion of the communication hole and also seal the end of the inner peripheral surface of each cylinder bore, thereby preventing a preplating solution used for preplating or a plating solution used for plating from leaking out and from contacting components other than the cylinder bores and the communication holes of each of the cylinders.

The nature and further characteristic features of the present invention will be made clearer from the following descriptions made with reference to the accompanying drawings.

BRIEF DESCRIPTION OF THE DRAWINGS

In the accompanying drawings:

FIGS. 4A and 4B are perspective views showing a clamping unit of the sealing jig shown in FIG. 2, in which FIG. 4A shows a closed state of the clamping unit and FIG. 4B shows an open state thereof;

DESCRIPTION OF THE PREFERRED EMBODIMENTS

The best mode for carrying out the present invention will be described hereunder with reference to the accompanying drawings. It is however to be noted that the present invention is not limited to any embodiment described herein, and terms "upper", "lower", "right", "left" and the like terms are used herein with reference to the illustrations of the respective drawings or in an actual installation state of the cylinder block plating apparatus.

Figure 1:
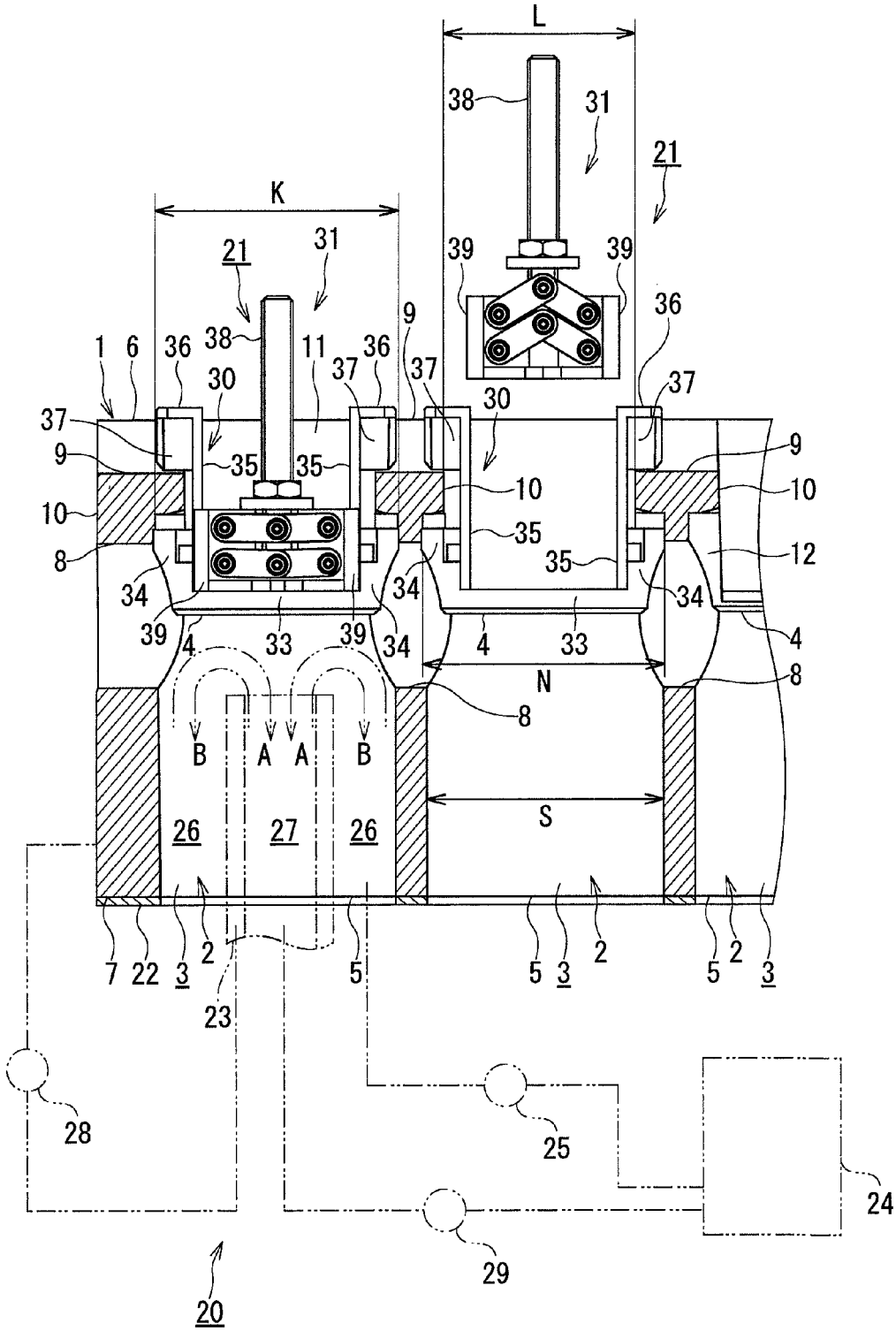
FIG. 1 is a sectional side view for the explanation of a way how a sealing jig for a cylinder block plating apparatus according to a first embodiment of the present invention seals an inner peripheral surface of each cylinder and a honing relief surface around communication holes.

FIG. 1 is a sectional side view illustrated for the explanation how a sealing jig (or sealing fixture) for a cylinder block plating apparatus according to a first embodiment of the present invention seals an inner peripheral surface (which may be called as a cylinder bore according to situations for the explanation hereunder) of each cylinder and a honing escape (or relief) surface around communication holes;

With reference to FIG. 1, a cylinder block plating apparatus 20 for a cylinder block 1 of a multi-cylinder engine of a vehicle, for example, seals one end portion 4 on the side of a crankcase mounting surface 6 of a cylinder bore 3 of each cylinder 2 in the cylinder block 1 by using a sealing jig 21 and seals the other end portion 5 on the side of a cylinder head mounting surface 7 by using a sealing sheet 22 having, for example, flat in shape, for introducing a process (treatment) liquid (i.e., preplating solution or plating solution) into the cylinder bores 3, and preplates or plates the inner peripheral surface of the cylinder 3 (or cylinder bore 3) at a high speed by using electrodes 23 arranged so as to oppose to the respective cylinder bores 3. Thus, a plated layer, though not shown, is formed in the cylinder bores 3, thereby improving wear resistance of the inner peripheral surface of the cylinder 3. Further, it is to be noted that the one end portion(s) 4 and the other end portion(s) 5 may be called "first end(s) 4 and second end(s) 5, hereinafter".

That is, in the preplating step, the preplating solution in a solution tank 24 is circulated by a liquid delivery pump 25 in a manner such that the preplating solution is first sent out from the solution tank 24, flows from below upward as shown in FIG. 1 in a gap channel 26 between the electrode 23 and the inner peripheral surface of the cylinder 3, then flows downward (as indicated by arrows A) in an internal channel 27 of the electrode 23 tubular in shape, and returns to the solution tank 24. This circulation cycle is repeated.

During this operation, a voltage is applied from a power supply 28 so as to create a situation in which the cylinder block 1 constitutes a positive pole and the electrode 23, on the other hand, constitutes a negative pole, thus making it possible to preplate the inner peripheral surface 3 of the cylinder 2 (for example, by electrolytic etching or anodic oxidation).

In a subsequent plating step, a plating solution in the solution tank 24 is circulated by a liquid delivery pump 29 in a manner such that the plating solution is sent out from the solution tank 24, flows from below upward, shown, in FIG. 1, in the internal channel 27 of the electrode 23, then flows into the gap channel 26 between the electrode 23 and the inner peripheral surface 3, as indicated by arrows B, flows from above downward in the gap channel 26, and returns to the solution tank 24. The above cycle is repeated.

During this operation, a voltage is applied from the power supply 28 in a manner such that the electrode 23 constitutes a positive pole and the cylinder block 1 constitutes a negative pole. Thus, the cylinder bore 3 of each cylinder 2 is plated to form a plated layer.

Figure 6:
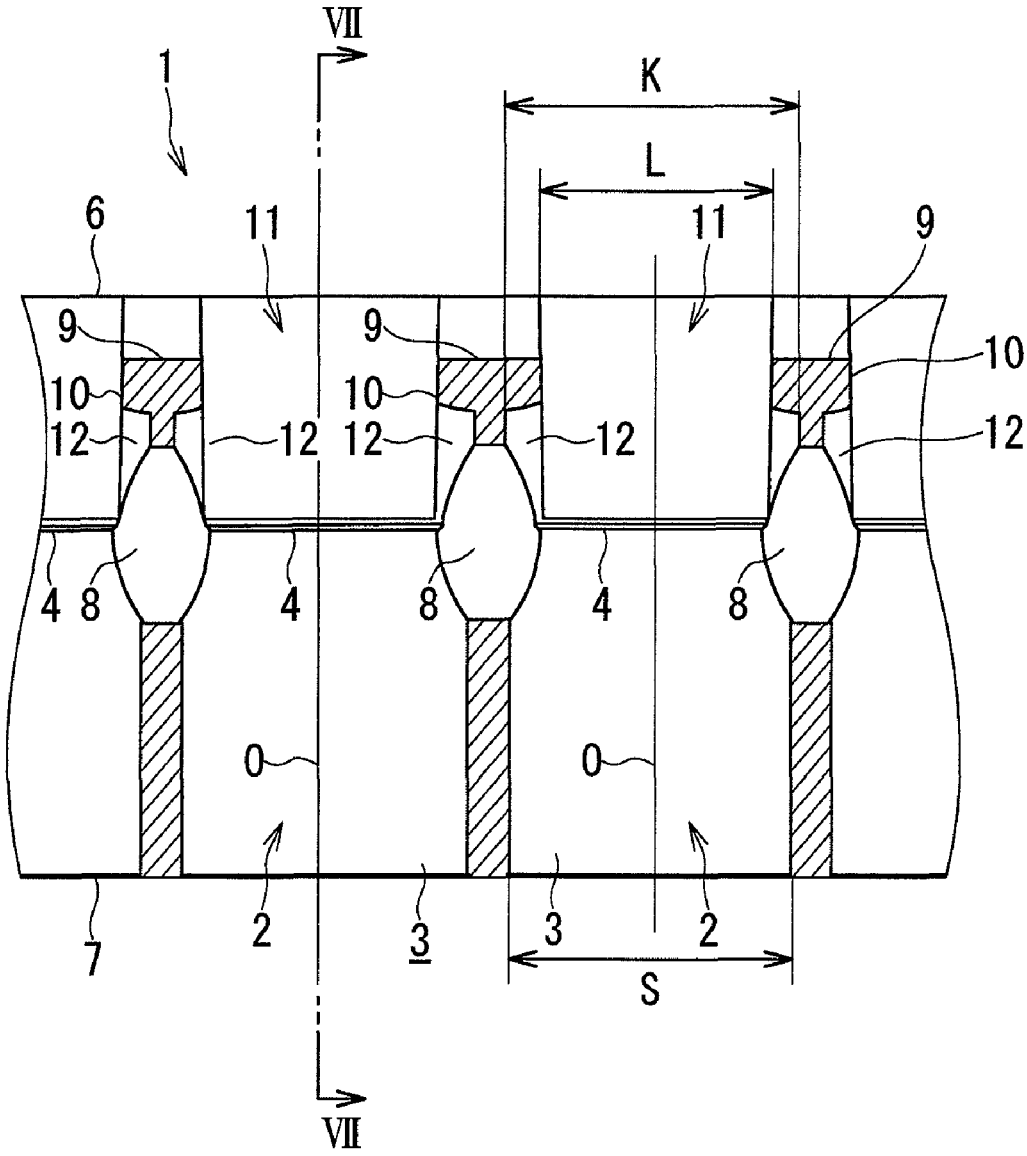
FIG. 6 is a sectional side view showing a cylinder block of a multi-cylinder engine.
Figure 7:
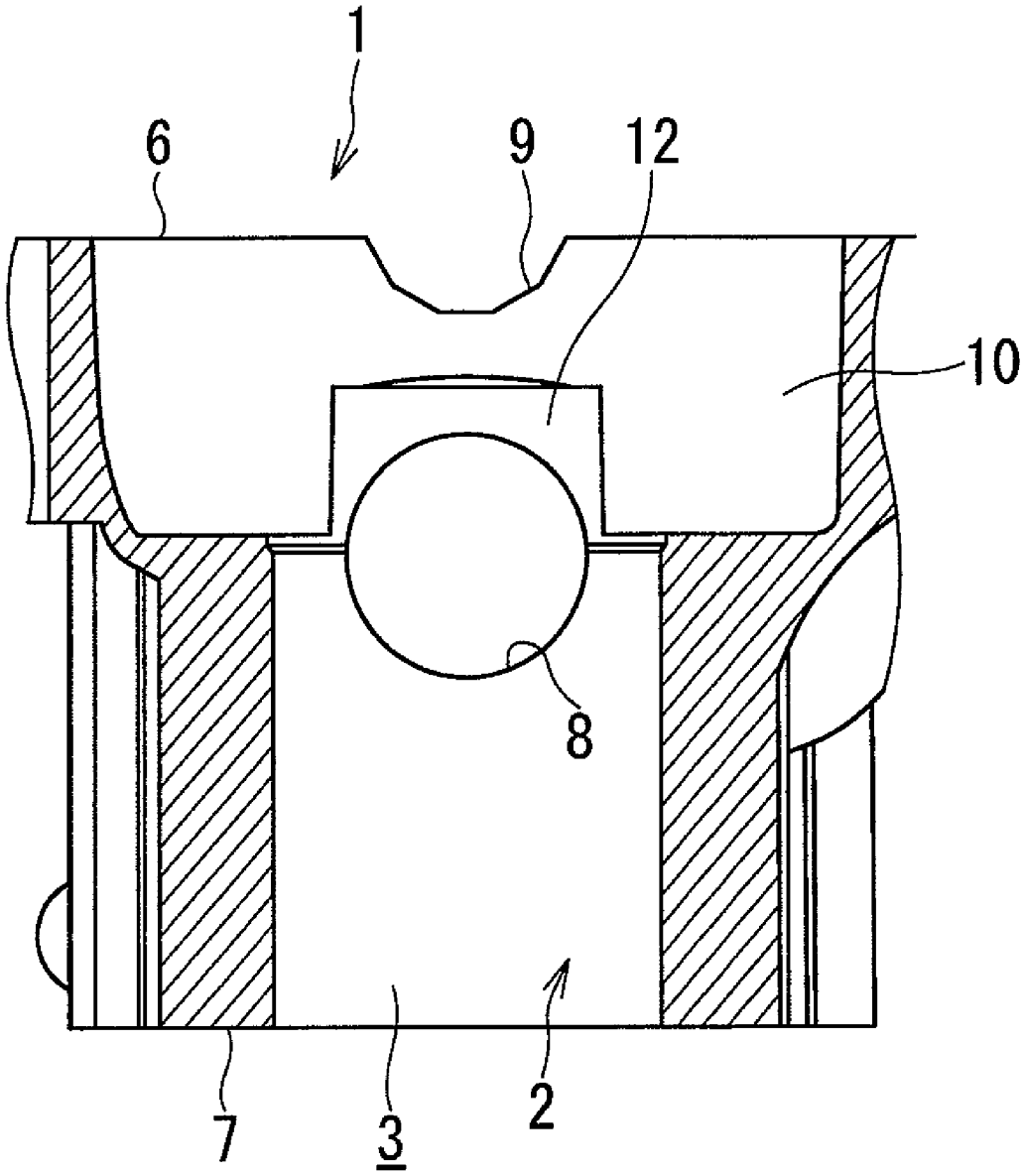
FIG. 7 is a sectional view taken along line VII-VII in FIG. 6.
Figure 8:
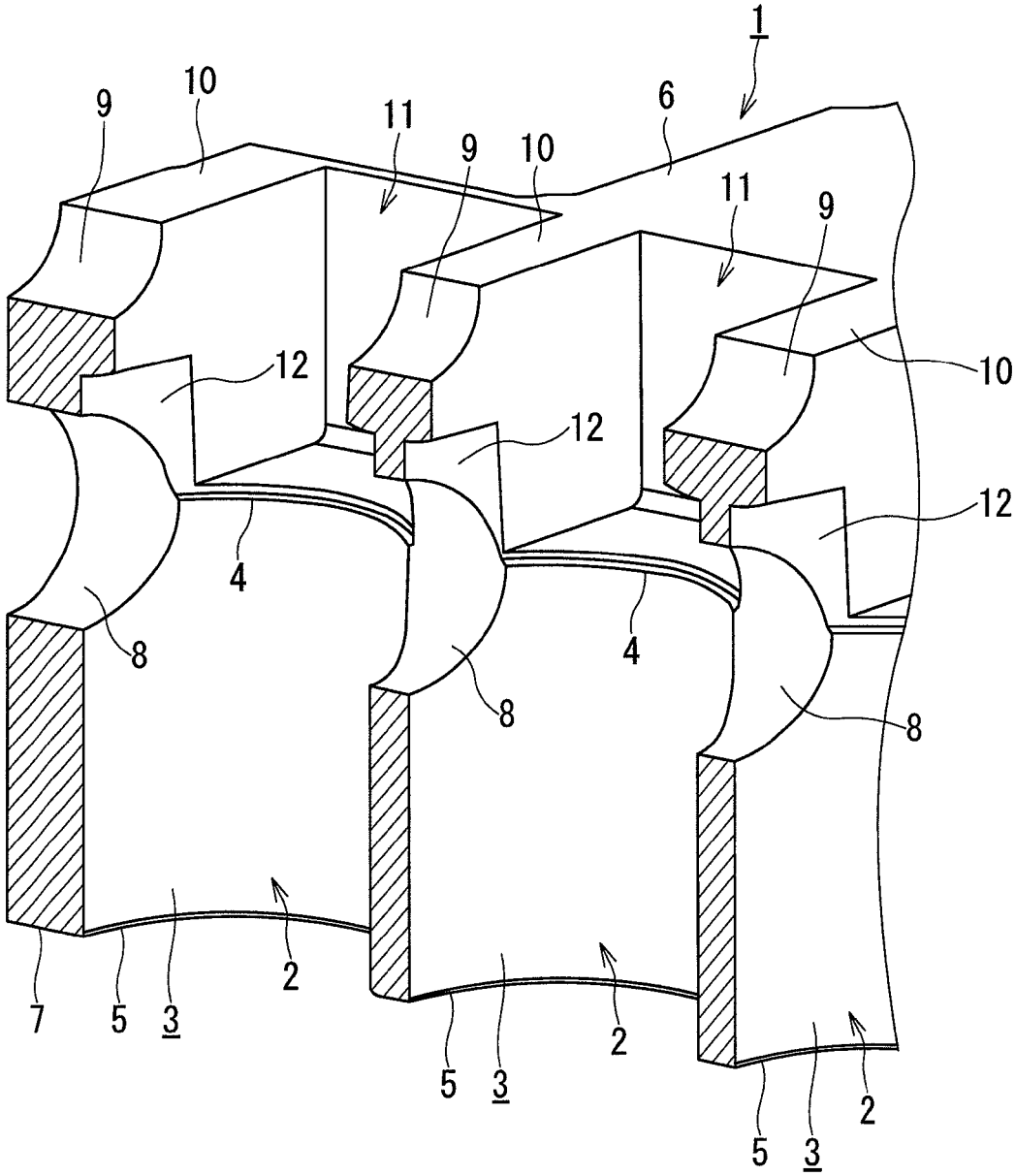
FIG. 8 is a cutaway perspective view of the cylinder block of the multi-cylinder engine shown in FIG. 6.

As shown in FIGS. 6 to 8, communication holes 8 are formed at the first ends 4 of the inner peripheral surfaces 3 of the cylinders 2 in the cylinder block 1 so as to traverse the cylinders 2 at the first ends 4, respectively. The communication holes 8 are formed for the purpose of establishing communication between the cylinders 2 when the engine is running, thereby preventing the internal pressure of a crankcase from increasing to thereby reduce pumping losses and to improve the engine power. Honing relief surfaces 12 (described later) provided around the communication holes 8 are sealed by the sealing jig 21 (described later in detail) together with the first ends 4 of the cylinder bores 3 as shown in FIG. 1.

Furthermore, as also shown in FIGS. 6 to 8, a plurality of crank journals 10 are arranged near the crankcase mounting surface 6 of the cylinder block 1, and the respective crank journals 10 are equipped with crank bearings 9 and are formed integrally between the crankcase mounting surface 6 and the first ends 4 of the cylinder bores 3.

Each of the crank journals 10 projects inward toward a center axis O of the corresponding cylinder 2 as specifically shown in FIG. 6. A distance L of an opening 11 between adjacent crank journals 10 is set to be smaller than a diameter S of the cylinder 2.

Each crank journal 10 has the honing relief surface 12 formed to a position facing the communication hole 8 as clearly shown in FIG. 7. The honing relief surface 12 is a portion provided to allow a honing stone, not shown, to move during the honing working in order to thoroughly hone the plated layer formed in the inner peripheral surface 3 of the cylinder bore of each cylinder 2 to the first end 4 of the cylinder bore 3. Therefore, the honing relief surface 12 has a curved surface which forms part of a circular cylindrical surface larger in radius than the cylinder bore 3. Further, a character "K" in FIG. 6 denotes a maximum value of a distance between the honing relief surfaces 12 of the adjacent crank journals 10.

Incidentally, the sealing jig 21 is attached to each cylinder 2 in the cylinder block 1 as shown in FIG. 1. As described above, the sealing jig 21 seals the first end (one end portion) 4 of the cylinder bore 3 of each cylinder 2 as well as a portion (i.e., the honing relief surface 12) located on an opposite side of the cylinder bore 3 near the communication holes 8. The sealing jig 21 is mounted or dismounted to or from the cylinder 2 from the side of the crankcase mounting surface 6 of the cylinder block 1.

Figure 2:
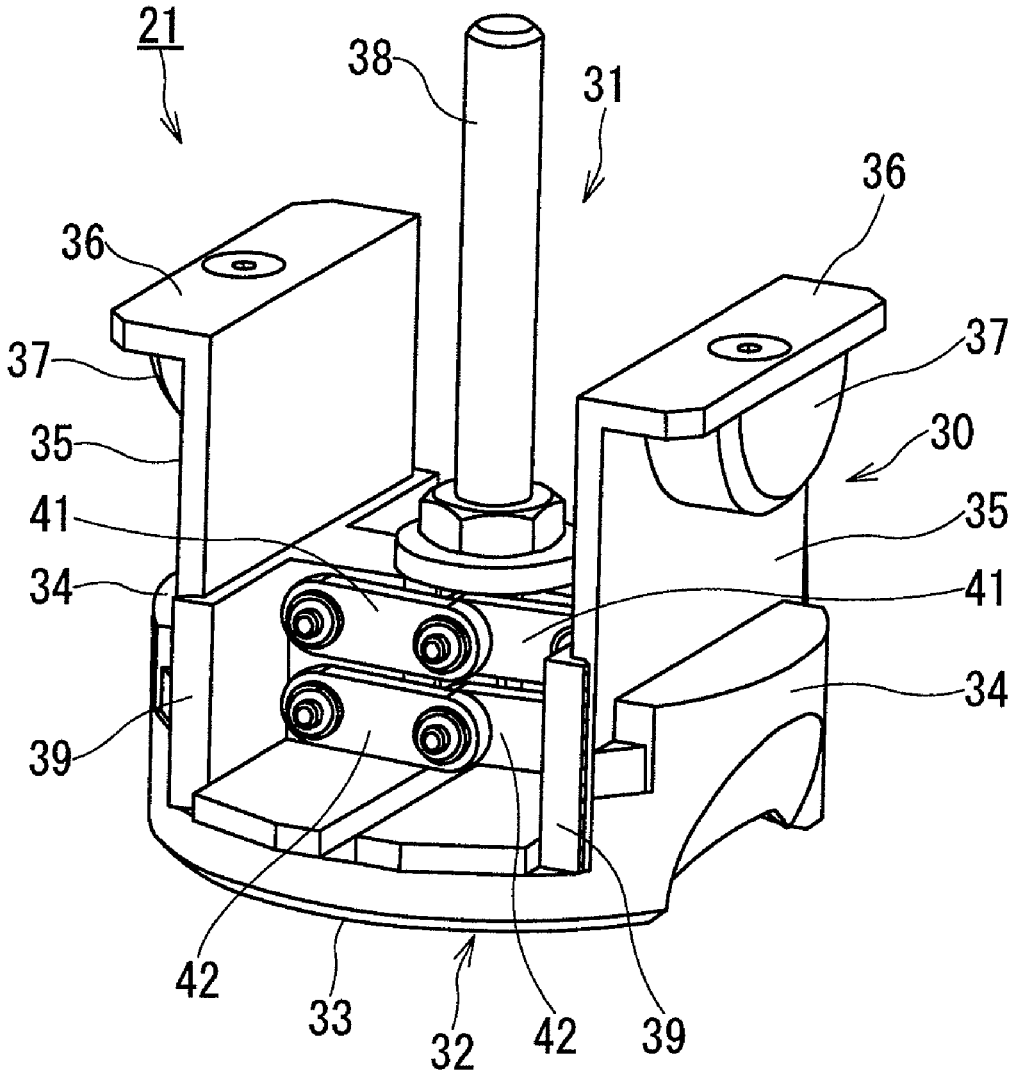
FIG. 2 is a perspective view of the sealing jig shown in FIG. 1.

Besides, the sealing jig 21 includes a sealing unit 30 and a clamping unit 31 as shown in FIG. 2 as well.

Figure 3:
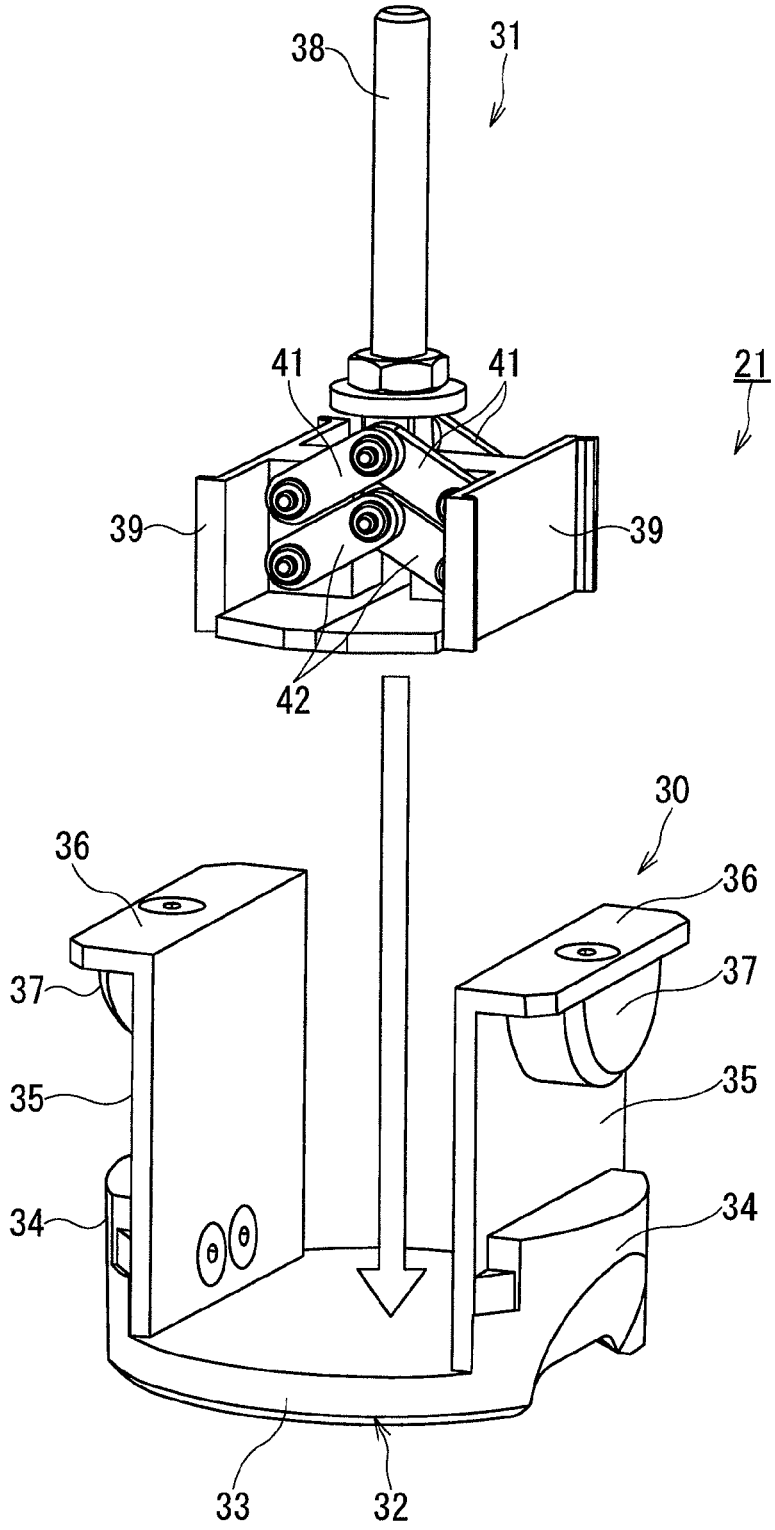
FIG. 3 is an exploded perspective view of the sealing jig shown in FIG. 2.

As shown in FIGS. 2 and 3, the sealing unit 30 includes a base 32 which is made of an elastic material, such as rubber, and is U-shaped as viewed from the front side. The base 32 includes an approximately circular bottom surface which functions as an inner peripheral surface seal 33 (bore seal 33) and a pair of shoulders erected on the inner peripheral surface seal 33, facing each other, to function as honing relief surface seals 34, i.e., communication hole seals. The inner peripheral surface seal 33 has an outer diameter approximately equal to a radius of the honing relief surface 12 and can seal the first end 4 of the inner peripheral surface (i.e., cylinder bore) 3, as shown in FIG. 1. The honing relief surface 34 has a curved surface which approximately corresponds to the curved surface of the honing relief surface 12 as shown in FIGS. 2 and 3 and can seal the honing relief surface 12.

Furthermore, in the sealing unit 30, a positioning bracket 35 stands upward from the inner surfaces of the sealing portions 34 of the respective honing relief surfaces, and an upper end of each of the positioning brackets 35 is bent outward to thereby arrange a positioning flange 36. Further, a positioning block 37 is also installed at a position near the location of the positioning flange 36 on an outer surface of each of the positioning brackets 35.

As shown in FIG. 1, when the positioning flanges 36 of the positioning brackets 35 are locked to the crankcase mounting surface 6 of the cylinder block 1, the sealing unit 30 is positioned at a level in height direction along the center axis O (FIG. 6) of the cylinder 2, and each of the bore seals 33 is placed in a position corresponding to the first end 4 of each of the cylinder bore 3. Furthermore, as the positioning block 37 is engaged with the crank bearing 9 of the crank journal 10, the sealing unit 30 is positioned along a circumferential direction of the cylinder bore 3, and the honing relief surface seal 34 takes a position facing each honing relief surface 12 of the cylinder block 1.

Figure 4B:
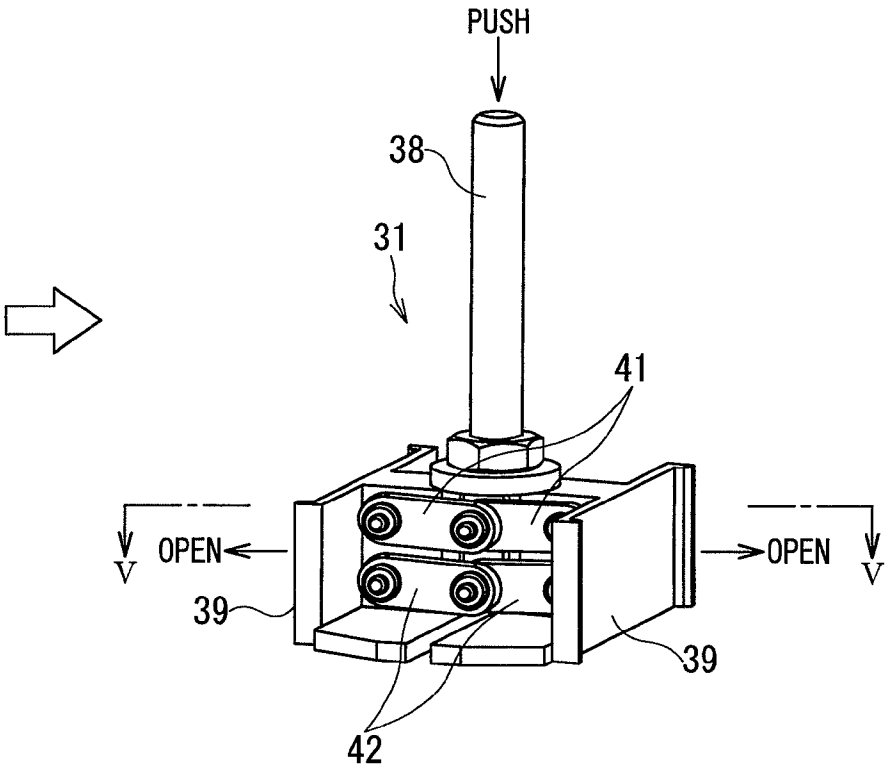
Figure 4A:
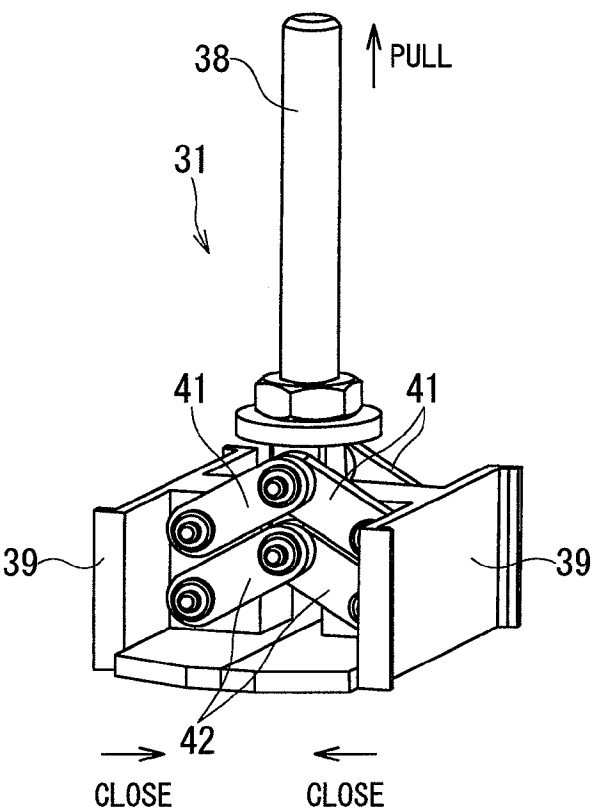
Figure 5:
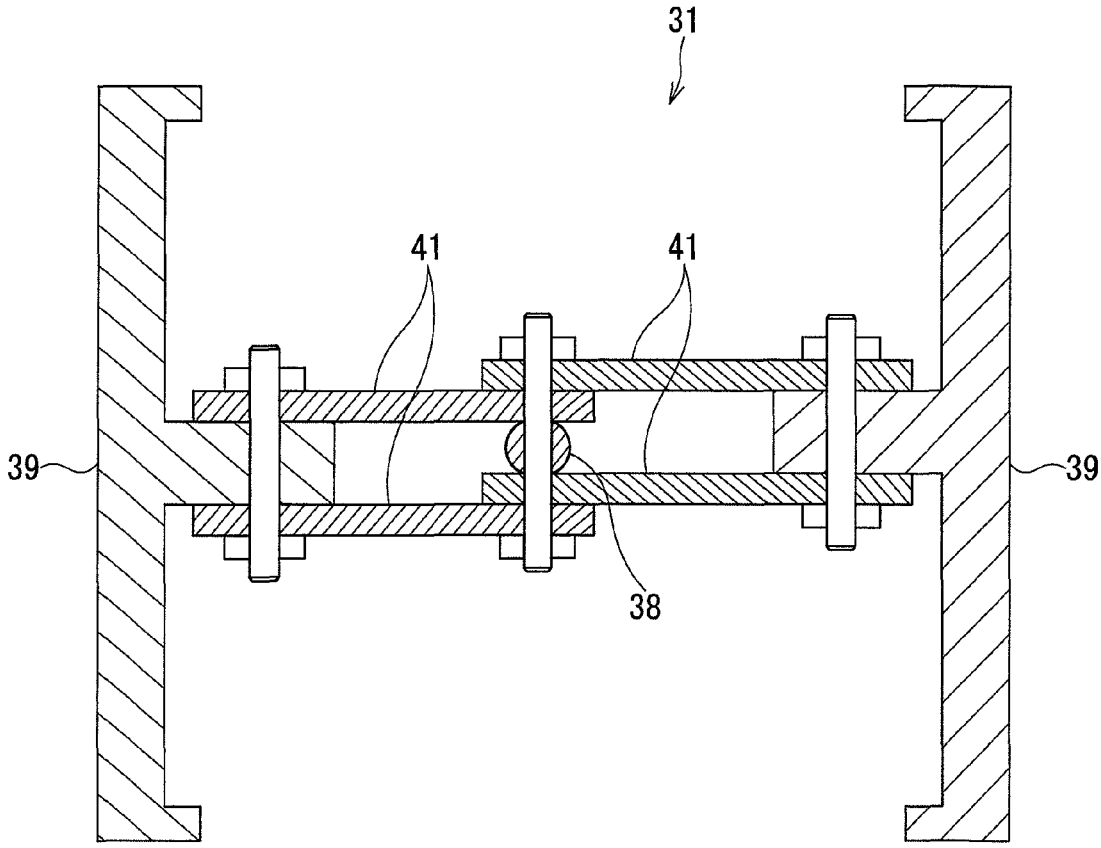
FIG. 5 is a schematic sectional view taken along line V-V in FIG. 4B.

As shown in FIGS. 4 and 5, each of the clamping units 31 has a structure in which a pair of pressure plates 39 are placed on opposite sides of a lifting rod 38, and the lifting rod 38 and the pressure plate 39 are connected by means of pins via a first link 41 and a second link 42. When the lifting rod 38 shown in FIG. 4A is pulled up, the pair of pressure plates 39 are brought close to each other and closed, making the clamping unit 31 ready to be inserted between the two positioning brackets 35 (i.e., into the sealing unit 30) of the sealing unit 30, as shown in FIGS. 2 and 3.

Then, the pair of pressure plates 39 of the clamping unit 31 are placed between the pair of positioning brackets 35 of the sealing unit 30 and in positions corresponding to the honing relief surface seals 34.

When the lifting rod 38 shown in FIG. 4B is pressed, the pair of pressure plates 39 are separated and forced open. As shown in FIGS. 1 and 2, when the pressure plates 39 of the clamping unit 31 are pushed open with the clamping unit 31 inserted in the sealing unit 30, the honing relief surface seal 34 of the sealing unit 30 is pressed against the honing relief surface 12 to thereby seal each honing relief surface 12.

Since the bore seals 33 of the sealing units 30 seal the first ends 4 of the cylinder bores 3, the first ends 4 of the cylinder bores 3 are sealed together with the honing relief surfaces 12 located on the opposite side of the cylinder bores 3 near the communication holes 8, with the cylinders 2 being communicated with each other via the communication holes 8.

The outside diameter of the bore seal 33 of the sealing unit 30 is approximately equal to the radius of the honing relief surface 12 and an interval N (FIG. 1) between the two honing relief surface seals 34 is approximately equal to the maximum value K of the distance between the honing relief surfaces 12.

Even when the bore seal 33 and the honing relief surface seal 34 are formed as described above and the distance L of the opening 11 between the crank journals 10 is smaller than the diameter S of the cylinder bore 3 and the maximum value K of the distance between the honing relief surfaces 12 as shown in FIG. 6, since the base 32 constituting the bore seal 33 and the honing relief surface seal 34 is configured to be easily deformable, because of being made of an elastic material, the sealing unit 30 can be attached between the first end 4 of the cylinder bore 3 and the honing relief surface 12 and removed therefrom through the opening 11 between the crank journals 10 from the side of the crankcase mounting surface 6 of the cylinder block 1 by deforming the base 32.

At the time of preplating or plating process or treatment, to seal the first end 4 of the cylinder bore 3 of each cylinder 2 (i.e., inner peripheral surface 3 of the cylinder 2), and the honing relief surface 12 around the communication hole 8, first the sealing unit 30 of the sealing jig 21 is inserted into each cylinder 2 from the side of the crankcase mounting surface 6 through the opening 11 between the crank journals 10. Then, the positioning flanges 36 of the positioning brackets 35 of the sealing unit 30 are locked to the crankcase mounting surface 6 of the cylinder block 1, the positioning blocks 37 are engaged with the crank bearings 9 of the crank journals 10, and the sealing unit 30 is positioned and mounted. In this state, the bore seal 33 of the sealing unit 30 seals the first end 4 of the cylinder bore 3.

In the next step in which the lifting rod 38 of the clamping unit 31 has being pulled up, the clamping unit 31 is inserted into the sealing unit 30. When the clamping unit 31 abuts against the bore seal 33 of the sealing unit 30, the lifting rod 38 of the clamping unit 31 is pressed to force the pressure plates 39 of the clamping unit 31 open. Consequently, the honing relief surface seals 34 of the sealing unit 30 are pressed against the honing relief surfaces 12 around the communication holes 8, thereby sealing the honing relief surfaces 12.

Thus, the sealing jig 21 according to the present embodiment provides advantages (1) to (3) described below.

(1) Even when the communication holes 8 are formed at the first end 4 of the cylinder bore (inner peripheral surface) 3 of each cylinder 2 in the cylinder block 1, the bore seal 33 of the sealing unit 30 of the sealing jig 21 seals the first end 4 of the cylinder bore 3 while the honing relief surface seals 34 of the sealing unit 30 of the clamping unit 31 seal the honing relief surfaces 12 located on the opposite side of the cylinder bore 3 near the communication holes 8 under the action of the clamping unit 31. Accordingly, the preplating solution used in the preplating step and the plating solution used in the plating step can be prevented from leaking out and also prevented from contacting components (e.g., wall surfaces of the crank journals 10) other than the cylinder bores 3 and the communication holes 8 of the cylinders 2.

(2) The base 32 constituting the bore seal 33 and the honing relief surface seals 34 of the sealing unit 30 of the sealing jig 21 is made of an elastic material, thus being easily deformable. Consequently, even when the distance L of the opening 11 between the crank journals 10 is smaller than the diameter S of the cylinder bore 3 and the maximum value K of the distance between the honing reliefs 12, the sealing unit 30 can be inserted through the opening 11 between the crank journals 10 from the side of the crankcase mounting surface 6 by bending the base 32 and can be attached easily to the first end 4 of the cylinder bore 3 and the honing relief surfaces 12 around the communication holes 8.

(3) In order to prevent leakage of the process liquid from the communication holes 8 formed in the cylinder bore 3, the pressure plates 39 of the clamping unit 31 of the sealing jig 21 is pushed open, thereby holding the honing relief surface seals 34 of the sealing unit 30 to the honing relief surfaces 12 around the communication holes 8, thereby sealing the honing relief surfaces 12 with the honing relief surface seals 34. This makes it possible to seal the honing relief surfaces 12 around the communication holes 8, thereby reliably preventing the process liquid from leaking from the communication holes 8 regardless of shape, size, or machining accuracy of the communication holes 8.

It is further to be noted that the present invention is not limited only to the described embodiments and many other changes and modifications may be made without departing from the scopes of the appended claims.

What is claimed is:

1. A sealing jig for a cylinder block plating apparatus which preplates or plates a cylinder bore of each cylinder in a cylinder block of a multi-cylinder engine with a process liquid introduced into the cylinder bore in a condition of sealing an end of the cylinder bore when a communication hole is formed at the end of the cylinder bore, the sealing jig comprising:

a sealing unit including a cylinder bore seal for sealing the end of an inner peripheral surface of the cylinder bore and a communication hole seal for sealing a portion, near a communication hole, opposite to the cylinder inner peripheral surface; and a clamping unit disposed in the sealing unit to be pushed open and adapted to cause the communication hole seal to seal the portion located on the opposite side of the cylinder bore near the communication hole.

2. The sealing jig for a cylinder block plating apparatus according to claim 1, wherein the end of the cylinder bore is located on a crankcase mounting surface side in a cylinder block in which a crank journal provided with a crank bearing extends inward of the cylinder.

3. The sealing jig for a cylinder block plating apparatus according to claim 2, wherein the sealing unit includes positioning brackets adapted to position the sealing unit at a level in a height direction by being locked to the crankcase mounting surface and positioning blocks adapted to position the sealing unit along a circumferential direction of the seal unit by being engaged with the crank bearings.

4. The sealing jig for a cylinder block plating apparatus according to claim 2, wherein the portion located on the opposite side of the cylinder bore on the periphery of the communication hole is a honing relief surface formed on each of the crank journals for use during honing working of the cylinder bore.

5. A method of sealing a cylinder block plating apparatus which preplates or plates a cylinder bore of each cylinder in a cylinder block of a multi-cylinder engine using a process liquid introduced into the cylinder bore in a condition of sealing an end of the cylinder bore when a communication hole is formed at the end of the cylinder bore, the sealing method comprising:

sealing the end of an inner peripheral surface of the cylinder bore; and sealing a portion located on an opposite side of the cylinder bore in a periphery of the communication hole.

* * * * *